United States Patent [19]

Wein

[11] 4,325,020

[45] Apr. 13, 1982

[54] REGULATING TRANSFORMER

[75] Inventor: Franz Wein, Regensburg, Fed. Rep. of Germany

[73] Assignee: Machinenfabrik Reinhausen Gebruder Scheubeck GmbH & Co KG, Regensburg, Fed. Rep. of Germany

[21] Appl. No.: 181,020

[22] Filed: Aug. 25, 1980

[30] Foreign Application Priority Data

Sep. 11, 1979 [DE] Fed. Rep. of Germany ..... 2936650

[51] Int. Cl.[3] ..... H01F 29/02

[52] U.S. Cl. ..... 323/340; 336/147; 336/150

[58] Field of Search ..... 323/256, 340, 342; 336/150, 145–147

[56] References Cited

U.S. PATENT DOCUMENTS

Re. 20,147 10/1936 McCarty ..... 323/256

3,474,326 10/1969 Lamberton ..... 323/340

*Primary Examiner*—William H. Beha, Jr.

*Attorney, Agent, or Firm*—Erwin Salzer

[57] ABSTRACT

A regulating transformer including a base winding and a plurality of auxiliary windings adapted to be connected in whole, or in part, to said base winding. The ends of each auxiliary winding and a point between its ends are passed through a bushing to a change-over switch arranged outside the transformer tank. The base winding of the transformer is connected to the movable contact of a first change-over switch. The movable contacts of continuous change-over switches are interconnected. The movable contact of the last change-over switch is connected to an outgoing line. Each change-over switch has a movable contact that can be selectively engaged with either of a pair of fixed contacts. One of the fixed contacts is connected to one of the ends of an auxiliary transformer winding. The other of the fixed contacts is connected to a point, or tap, between the ends of the auxiliary winding.

1 Claim, 1 Drawing Figure

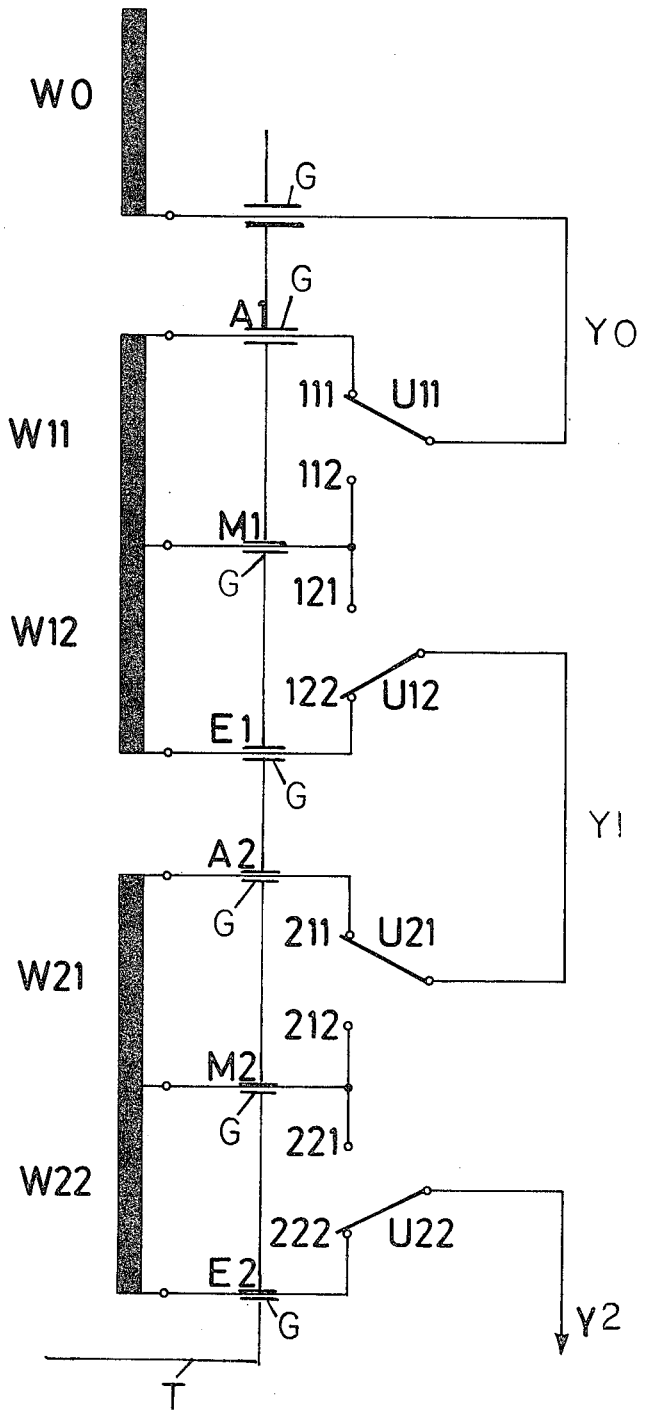
W0
G
G
A1
Y0
111
U11
W11
112
M1
G
121
W12
122
U12
E1
G
Y1
A2
G
211
U21
W21
212
M2
G
221
W22
222
U22
E2
G
Y2
T

REGULATING TRANSFORMER

BACKGROUND OF THE INVENTION

This invention relates to regulating transformers capable of delivering various voltages, of which some may be higher, and others lower, than a predetermined voltage. Such transformers include generally a plurality of taps of which each is connected to a bushing leading from the tank in which the transformer is housed to the outside of the tank. Outside of the tank in which the transformer is housed electromechanically or electronically operated switching devices interconnect the various taps in various ways, and thus establish the required, or desired voltages. Prior art designs of this character require one bushing for each voltage which is desired, or needed, outside the transformer housing, or tank. The large number of required bushings greatly increases the cost of tapped transformers of the kind under consideration.

It is, therefore, an object of this invention to reduce the cost of regulating transformers, to reduce the number of bushings required, and to achieve this end without reducing the number of voltage steps, or voltage intervals. Other objects of the invention will become apparent as this specification proceeds.

A regulating transformer according to this invention includes a base winding and a plurality of aligned auxiliary windings adapted to be connected in whole or in part to said base winding. Each of said auxiliary windings has two ends and a tap between said two ends. A transformer according to this invention further includes a plurality of pairs of aligned change-over switches, the number of said pairs of change-over switches being equal to the number of said auxiliary windings. Each pair of change-over switches includes a first and a second fixed contact, and a first movable contact adapted to engage selectively said first and said second fixed contact, and each pair of change-over switches further includes a third and a fourth fixed contact and a second movable contact adapted to engage selectively each of said third and fourth fixed contacts. Said first fixed contact of each pair of change-over switches being conductively connected to one end of one of said auxiliary windings, said second and said third fixed contacts of each of said pair of change-over switches being conductively connected to said tap of one of said auxiliary windings, and said fourth fixed contacts of each pair of said change-over switches being conductively connected to the other end of one of said auxiliary windings. A point of said base winding is conductively connected to said first movable contact in the line of said pairs of change-over switches. Conductive connections interconnect the movable contacts of said change-over switches according to their alignment.

BRIEF DESCRIPTION OF THE DRAWING

The drawing illustrates diagrammatically a transformer according to the present invention.

DESCRIPTION OF PREFERRED EMBODIMENT

Referring to the drawing, letters WO have been applied to indicate the base winding of a transformer according to this invention, and reference characters W11,W12 and W21,W22 have been applied to indicate two auxiliary windings. Auxiliary winding W11,W12 has two end terminals A1,E1 and auxiliary winding W21,W22 has two terminals A2,E2. Winding W11,W12 has a tap M1 and winding W21,W22 has a tap M2. Taps M1 and M2 may be center taps. A first pair of change-over switches is arranged close to winding W11,W12, and a second pair of change-over switches is arranged close to winding W21,W22. The first pair of change-over switches close to winding W11,W12 comprises fixed contacts 111,112,121 and 122. The second pair of change-over switches arranged close to winding W21,W22 comprises fixed contacts 211,212,221 and 222. The first pair of change-over switches close to winding W11,W12 comprises movable contacts U11 and U12. The second pair of change-over switches close to winding W21,W22 comprises movable contacts U21 and U22. Fixed contacts 111 and 112 may be selectively engaged by movable contact U11, and fixed contacts 211 and 212 may be selectively engaged by movable contact U21. Fixed contacts 121 and 122 may be selectively engaged by movable contact U12 and fixed contacts 221 and 222 may be selectively engaged by movable contact U22. Fixed contact 111 is connected to end terminal A1, fixed contacts 112 and 121 are connected to tap M1 and fixed contact 122 is connected to end terminal E1. The fixed contact 211 of the second change-over switch is connected to end terminal A2, the fixed contacts 212 and 221 of that switch are connected to tap M2 and the fixed contact 222 of that switch is connected to end terminal E2 of auxiliary winding W21,W22. Line YO connects a point of base winding WO to movable contact U11, a line Y1 connects movable contacts U12 and U21 and reference character Y2 has been applied to indicate an outgoing line connected to movable contact U22. Reference character T has been applied to indicate in part the wall of the tank or housing of the transformer, and reference character G has been applied to indicate the bushings through which the windings WO; W11 ,W12;W21, W22 and the taps M1,M2 are connected with the various change-over switches outside the transformer tank or housing.

The above described structure differs from prior art transformers in that in the latter each auxiliary winding required two bushings, one for each of its ends, while in the structure according to this invention only the end terminals A1,E1 and A2,E2 and the taps M1 and M2 are connected through bushings G to switching devices which are located outside the transformer tank. In other words, windings W11 and W12 require both three bushings G and windings W21 and W22 also require but three bushings G.

The number of auxiliary windings may either be increased, or decreased, as desired, or required, depending upon the range of regulation and the width of each voltage step required. Instead of imparting equal numbers of turns to each auxiliary winding such as W11,W12 and providing the latter with a center tap, the portions W11 and W12 of winding W11,W12 may have different numbers of turns. Thus, the partial winding W11 may have n turns, the partial winding W12 may have 2.n turns, the partial winding W21 may have 4.n turns, etc.

In star-connected three-phase transformers line Y2 is connected to the joint point of the three windings.

The operation of a transformer as described above and illustrated is as follows:

In the position of the parts shown in the drawing the base winding WO and all auxiliary windings W11,W12 and W21,W22 are connected in series. The regulation of the voltage is effected by operation of the change-over switches. If the movable contact U22 is separated from its cooperating fixed contact 222, the auxiliary partial or part winding W22 is taken out of the circuit. By moving movable contact U21 from fixed contact 211 to fixed contact 212 also the auxiliary part winding W21 is taken out of the circuit. If departing from the positions of the parts shown in the drawing all movable contacts U11-,U12,U21 and U22 are switched over from the fixed contact they are currently engaged with to the opposite fixed contact, a direct current path is established from base winding WO to outgoing line Y2. This current path is as follows: WO;YO;U11,112;121;U12;Y1-;U21;212;221;U22,Y2. The addition or disconnection of partial auxiliary windings may be effected by operation of the change-over switches in any desired sequence.

It will be apparent from the foregoing that transformers according to this invention have the great advantage over prior art regulating transformers of requiring a smaller amount of bushings, and thus greatly reducing the cost of the transformers.

I claim as my invention:

1. A regulating transformer comprising (a) a base winding;

(b) a plurality of aligned auxiliary windings adapted to be serially connected in whole or in part to said base winding;

(c) each of said auxiliary windings having two ends and a tap between said two ends;

(d) a plurality of pairs of aligned change-over switches, the number of said pairs of change-over switches being equal to the number of said auxiliary windings;

(e) each pair of change-over switches including a first and a second fixed contact and a first movable contact adapted to engage selectively said first and said second fixed contact, and each pair of change-over switches further including a third and a fourth fixed contact and a second movable contact adapted to engage selectively each of said third and fourth fixed contacts;

(f) said first fixed contact of each pair of change-over switches being conductively connected to one end of one of said auxiliary windings, said second and said third fixed contacts of each of said pair of change-over switches being conductively connected to said tap of one of said auxiliary windings, and said fourth fixed contact of each pair of said change-over switches being conductively connected to the other end of one of said auxiliary windings;

(g) a point of said base winding being conductively connected to said first movable contact in the line of said pairs of change-over switches; and (h) conductive connections interconnecting the movable contacts of said change-over switches according to their alignment.

* * * * *